United States Patent [19]

Gessner et al.

[11] Patent Number: 4,830,904

[45] Date of Patent: May 16, 1989

[54] POROUS THERMOFORMABLE HEAT SEALABLE NONWOVEN FABRIC

[75] Inventors: Scott L. Gessner; Henry S. Ostrowski, both of Greenville, S.C.

[73] Assignee: James River Corporation, Richmond, Va.

[21] Appl. No.: 117,292

[22] Filed: Nov. 6, 1987

[51] Int. Cl.[4] ..... C11D 17/04; D04H 1/54; D04H 1/74

[52] U.S. Cl. ..... 428/219; 34/9; 206/524.1; 252/90; 383/102; 383/105; 427/242; 428/36.1; 428/288; 428/296; 428/359; 428/373; 428/374; 428/395; 428/401

[58] Field of Search ..... 428/219, 288, 296, 359, 428/373, 374, 395, 401

[56] References Cited

U.S. PATENT DOCUMENTS

| | | |
|---|---|---|
| 4,259,373 | 3/1981 | Demessemaekers et al. . |
| 4,421,813 | 12/1983 | Athey . |
| 4,454,196 | 6/1984 | Iohara et al. . |
| 4,525,404 | 6/1985 | Matsui et al. . |
| 4,536,440 | 8/1985 | Berg . |
| 4,547,420 | 10/1985 | Krueger et al. . |
| 4,659,496 | 4/1987 | Klemm et al. . |

*Primary Examiner*—James C. Cannon

*Attorney, Agent, or Firm*—Finnegan, Henderson, Farabow, Garrett & Dunner

[57] ABSTRACT

A porous thermoformable heat sealable nonwoven fabric that is constructed by carding a bicomponent polymeric fiber and then heating the resulting fibrous web to cause bonding. The polymeric components of the bicomponent fiber have crystalline melting points that differ by at least 30° C. The bicomponent fiber has a staple length ranging from 1.5" to 3.0" and a staple elongation-to-break of at least 30%.

19 Claims, No Drawings

POROUS THERMOFORMABLE HEAT SEALABLE NONWOVEN FABRIC

BACKGROUND OF THE INVENTION

The present invention relates to a porous, thermoformable, heat sealable, nonwoven fabric. The fabric is useful in applications which require the controlled delivery of a material from within a container composed of the fabric.

Conventional fabric materials, for example, Reemay® 2420, used in making containers for the controlled delivery of products such as powders from within the container, consist of fabrics made from spunbonded polyester fibers. These conventional fabrics have a number of disadvantages for use in this type of application. The porosity of conventional spunbonded material is difficult to control because of web nonuniformity that is inherent in spunbonded fabric. As a result, a spunbonded fabric having a desired porosity is difficult to manufacture. Therefore, a container such as a pouch made of spunbonded polyester fibers would tend to allow amounts of the contained materials to escape through the fabric prior to the desired time for delivery of the contained product. Thus, the product may escape during product assembly, packaging and handling, while on the other hand, some product may be delivered too early, too late or not at all. For example, the present invention is useful in laundry systems, it being important in such an application that a detergent, bleach, or softener be delivered from a fabric pouch at the desired time.

Conventional polyester spunbonded fabrics also are not heat sealed, heat sealing taking place only at relatively high temperatures and at a relatively slow rate. Therefore, in order to form a container composed of spunbonded polyester fibers, it may be necessary to utilize costly adhesives to seal the spunbonded fabric together.

SUMMARY OF THE INVENTION

The present invention overcomes the problems and disadvantages of the prior art by providing a nonwoven fabric composed of multiple fibers which form a uniform web when heated together. This uniform web enables a product having a substantially uniform desired porosity to be produced. Therefore, a container made of the nonwoven fabric of the present invention will eliminate or minimize the premature escape of a contained material and will allow a rapid delivery of the contained material at the desired time.

In addition, the nonwoven fabric of the present invention is heat sealable at much lower temperatures and at much higher rates than the spunbonded fabric of the prior art. Therefore, it is relatively easy to form a container such as a pouch by het sealing the fabric together.

The fabric of the present invention is also thermoformable, i.e., capable of being formed into a desired shape while applying heat, and is also chemically inert to product contents such as, for example, laundry detergents, bleaches, and softeners.

Additional advantages of the invention will be set forth in part in the description which follows, and in part will be obvious from the description of, or may be learned by practice of the invention. The advantages of the invention may be realized and attained by means of the instrumentalities and combinations particularly pointed out in the appended claims.

In accordance with the purpose of the invention, as embodied and broadly described herein, the porous thermoformable heat sealable nonwoven fabric comprises a bicomponent polymeric fiber carded and then bonded together. The bicomponent polymeric fiber has a staple length ranging from 1.5 inches to 3.0 inches, a staple elongation-to-break of at least 30%, and the crystalline melting points of the components of the bicomponent polymeric fiber differ by at least 30° C.

DESCRIPTION OF THE PREFERRED EMBODIMENTS

Reference will now be made in detail to the presently preferred embodiments of the invention.

In accordance with the present invention, the porous thermoformable heat sealable nonwoven fabric is formed by carding a bicomponent fiber to form a fibrous web. Carding refers to the conventional process well known in the art of "combing" the filaments of the individual fibers to entangle the fibers thus forming a two dimensional web of fiber material. The carding can be carried out using conventional carding equipment.

In accordance with the invention, the fibrous web formed after carding is then heated to cause the bonding of the fibrous web. This heat bonding of the fibrous web can be carried out by means of conventional calender rolls or by "through air" bonding.

The overall process of carding the individual fibers to form a web of fibrous material and then heating the fibrous web to cause bonding of the material is known in the art and will be referred to herein as thermalbonding.

The thermalbonding process enables the formation of a fabric with a more uniform porosity than fabric formed by the spunbonded process of the prior art. The process of carding enables the positioning of individual fibers to be controlled mechanically whereas the prior art spunbonding process relies on air currents to position the individual filaments, which results in a more random filament distribution. The controlled filament positioning of the present invention thus produces a fabric having a more uniform porosity.

The bicomponent polymeric fiber in accordance with the invention has a staple length ranging between 1.5 inches to 3.0 inches, a staple elongation-to-break of at least 30% and the crystalline melting points of the components of the bicomponent fiber differ by at least 30° C.

The relatively long staple length of the invention aids in the distribution of the deforming load throughout the fabric. An even load distribution during the deformation of the fabric diminishes the instances of failures in the form of tears. The preferred staple length is approximately 2.25 inches.

The relatively high staple elongation-to-break of the invention reduces tearing by allowing each filament to elongate with a deforming load rather than fail, thereby enabling a larger percentage of fibers to bear and distribute the deforming load. Suitable staple elongation-to-break values range from 30% to 350%, however, the upper limit is not critical and may be varied according to the anticipated deforming load. A preferred staple elongation-to-break is approximately 100%.

In accordance with the invention, the crystalline melting points of the components of the bicomponent polymeric fiber differ by at least 30° C. This difference in melting points in the bicomponent fiber allows for the heat bonding of the fibrous web. The lower melting point polymer of the bicomponent pair melts first upon heating, causing the bonding of the bicomponent fiber. It may be important, depending on the specific application, for the initial bond formed by the lower melting component to be subsequently maintained at high temperatures. This would be true, for example, if the fabric were to be used in high temperature applications, such as in commercial dryers. Although the lower melting component of the fiber may soften at high temperatures, such as 150° C., the resultant fabric should not readily adhere to metal or other fabrics.

It is important to the present invention that the bicomponent fibers be heat bonded at temperatures that will not disturb the crystalline orientation of the higher melting component. Therefore, it is preferable that the crystalline melting points of the components of the bicomponent fiber differ by at least 50° C. This will enable thorough bonding of the fibrous web with essentially no reduction of the individual fiber tenacity.

The lower melting component of the bicomponent pair also enables the final product such as a container to be formed by heat sealing the fabric together. Thus, the fabric of the present invention, in the form of a sheet after thermalbonding, can be formed into a shape suitable for a container by heating the ends of the fabric sheet together to heat seal them. This eliminates the need for costly adhesives.

The bicomponent fiber components of the invention may be arranged either in radial, orbital, side-by-side or sheath/core configurations. The radial configuration refers to the two polymer domains in the fiber cross section arranged in alternating pie shaped configurations. The orbital configuration consists of a central polymer domain composed of one polymer that forms the axis of the filament, with a plurality of orbital polymer domains, composed of the other polymer, located around the perimeter of the filament surface parallel to the filament axis. The side-by-side configuration refers simply to the polymer domains being located longitudinally adjacent to one the sheath/core configuration, one of the polymer component pairs surrounds the outside of the other polymer component. It is important to the present invention that the sheath component, the surrounding component, has a lower melting point than the core or inside component. The sheath/core configuration is preferred because the choice of core material in that arrangement will not be limited to those polymers which are chemically compatible with the material to be contained within the fabric container.

In accordance with the present invention, the bicomponent fiber may be carded together with up to 75% by weight of a non-bicomponent fiber followed by heating to cause bonding. Non-bicomponent fibers suitable for carding with the bicomponent fiber include polyesters, polypropylene, rayon, nylon 6, nylon 6/6, cotton or acrylics.

In accordance with the invention, the bicomponent fiber may also consist of a blend of bicomponent polymeric fibers.

The bicomponent polymeric materials of the invention may be chosen from among the following polymer pairs:

Polypropylene/Polyethylene terephthalate
Polypropylene/Nylon 6
Polypropylene/Nylon 6,6
Nylon 6/Polyethylene terephthalate
Copolyester/polyethylene terephthalate
Copolyester/Nylon 6
Copolyester/Nylon 6,6
Copolyester/Nylon 6,6
Poly 4-methyl, 1-pentene/Polyethylene terephthalate
Poly 4-methyl, 1-pentene/Nylon 6
Poly 4-methyl, 1-pentene/Nylon 6,6

Copolyesters suitable for use in the bicomponent polymeric fiber pairs include polyethylene isophthalate, polybutylene terephthalate and both cis and trans poly-1,4-cyclohexylenedimethyleneterephthalate.

In accordance with the invention, the bicomponent fiber components preferably are present in a ratio ranging from 1:3 to 3:1 by weight and more preferably approximately 1:1 by weight. The bicomponent fiber and the non-bicomponent fiber, when used, preferably have a denier ranging from 1.5 dpf (denier per filament) to 11 dpf and more preferably are approximately 6.0 dpf. Denier is a standard measure of fiber diameter used in the art and represents grams/9,000 meters. The fabric has a Frazier air permeability ranging from 450 cfm to 650 cfm and more preferably is approximately 550 cfm. The bicomponent fiber has a tenacity of at least 0.75 grams/denier and more preferably is approximately 2.0 grams/denier. The fabric preferably has a basis weight ranging from 0.5 ounces/square yard to 3.0 ounces/-square yard and more preferably is approximately 1.3 ounces/square yard.

The nonwoven fabric of the present invention is highly moldable or thermoformable. This means that a product composed of the fabric having a selected shape can be obtained by heating the fabric and forming it to the desired shape. The fabric is capable of deformation of up to 20% in the direction parallel to the carding direction and up to 50% in the direction perpendicular to the carding direction while maintaining the fabric pore size and pore size distribution within desired limits.

The following example further illustrates a preferred embodiment of the present invention. The example should in no way be considered limiting but is merely illustrative of the various features of the present invention.

EXAMPLE

A 2.25 inch long staple bicomponent fiber of eccentric sheath/core polypropylene/polyethylene terephthalate (50/50), 6 denier per filament (dpf), 0.85 tenacity and 200% elongation-to-break was carded on conventional equipment and heat bonded between heated (298 degrees centigrade) calender rolls at 150 pounds per linear inch at a rate of 120 feet per minute. The filament orientation was partially randomized using known scrambling techniques to maximize the cross direction (CD) tensile. The following fabric properties were obtained:

Basis weight: 1.37 ounces/square yard
Loft: 0.0178 inches
Grab Tensile
  MD: 7.8 lbs/inch
  CD: 5.0 lbs/inch
Grab elongation
  MD: 31%
  CD: 83%
1" Strip Tensile
  MD: 3.3 lbs./inch
  CD: 1.3 lbs./inch
1" Strip Elongation
  MD: 35%
  CD: 67%

Frazier Air Permeability: 579 cubic feet/minute

This material was thermoformed into a fabric container having a cell depth of ⅜" and volume of 39 cubic centimeters at a deformation cycle time of 300 msec.

The following tests were conducted to obtain the above parameter values:

Loft—ASTM D 1777
Grab tensile—ASTM D 1682
Grab elongation—ASTM D 1682
One inch strip tensile—ASTM D 1682
One inch elongation—ASTM D 1682

Although the present invention has been described in connection with preferred embodiments, it is understood that modifications and variations may be resorted to without departing from the spirit and scope of the invention. Such modifications are considered to be within the purview and scope of the invention and the appended claims.

What is claimed is:

1. A porous thermoformable heat sealable nonwoven fabric having a basis weight ranging from 0.5 ounces per square yard to 3.0 ounces per square yard comprising:

bicomponent polymeric fibers carded and then bonded together, said fibers having a staple length ranging from 1.5" to 3.0" and a staple elongation-to-break of at least 30%, wherein the crystalline melting points of the components of said bicomponent polymeric fibers differ by at least 30° C.

2. The fabric of claim 1, further comprising a non-bicomponent fiber carded and bonded with said bicomponent fibers.

3. The fabric of claim 1, wherein said fabric comprises a blend of bicomponent fibers.

4. The fabric of claim 1, wherein said bicomponent fiber materials are selected from the group consisting of polypropylene/polyethylene terephthalate; polypropylene/nylon 6; polypropylene/nylon 6,6; nylon 6/polyethylene terephthalate, copolyester/polyethylene terephthalate; copolyester/nylon 6; copolyester/nylon 6,6; poly 4-methyl, 1-pentene/polyethylene terephthalate; poly 4-methyl, 1-pentene/nylon 6 and poly 4-methyl, 1-pentene/nylon 6,6.

5. The fabric of claim 1, wherein said fiber staple length is approximately 2.25 inches.

6. The fabric of claim 1, wherein said staple fiber elongation-to-break is approximately 100%.

7. The fabric of claim 1, wherein said crystalline melting points differ by approximately 50° C.

8. The fabric of claim 1, wherein said bicomponent polymeric fiber components are arranged in radial, orbital, side-by-side or sheath/core configurations.

9. The fabric of claim 8, wherein said configuration is sheath/core.

10. The fabric of claim 9, wherein the melting point of said sheath component is lower than the melting point of said core component.

11. The fabric of claim 1, wherein the components of said bicomponent polymeric fibers are present in a ratio from 1:3 to 3:1 by weight.

12. The fabric of claim 11, wherein said bicomponent ratio is approximately 1:1 by weight.

13. The fabric of claim 1, wherein said bicomponent fibers have a denier ranging from 1.5 dpf to 11 dpf.

14. The fabric of claim 13, wherein said denier is approximately 6.0 dpf.

15. The fabric of claim 1, wherein said fabric has a Frazier air permeability ranging from 450 cfm to 650 cfm.

16. The fabric of claim 15, wherein said Frazier air permeability is approximately 550 cfm.

17. The fabric of claim 1, wherein said bicomponent fibers have a tenacity of at least 0.75 grams/denier.

18. The fabric of claim 17, wherein said tenacity is approximately 2.0 grams/denier.

19. The fabric of claim 1, wherein said basis weight is approximately 1.3 ounces per square yard.

* * * * *